US005546629A

United States Patent [19]

Shim

[11] Patent Number: 5,546,629

[45] Date of Patent: Aug. 20, 1996

[54] BALL CLEANING DEVICE

[76] Inventor: Sang B. Shim, Yaksu Apt. 5-102, 216-3, Sangdo-dong, Dongjak-ku, Seoul, Rep. of Korea

[21] Appl. No.: 490,397

[22] Filed: Jun. 14, 1995

[30] Foreign Application Priority Data

Nov. 16, 1994 [KR] Rep. of Korea ..... 94-30511
Apr. 20, 1995 [KR] Rep. of Korea ..... 95-9308

[51] Int. Cl.[6] ..... A63B 47/04

[52] U.S. Cl. ..... 15/302; 15/21.2; 15/97.1; 134/142

[58] Field of Search ..... 15/21.2, 97.1, 15/302, 310, 311; 134/142

[56] References Cited

U.S. PATENT DOCUMENTS

| | | | |
|---|---|---|---|
| 1,702,202 | 2/1929 | Day | 15/21.2 |
| 1,787,306 | 12/1930 | Day | 15/21.2 |
| 1,792,211 | 2/1931 | Brewer | 15/21.2 |
| 1,796,704 | 3/1931 | Day | 15/21.2 |
| 2,031,633 | 2/1936 | Brillhart | 15/97.1 |
| 2,992,446 | 7/1961 | Wise | 15/97.1 |
| 3,077,626 | 2/1963 | Thomson | 15/97.1 |
| 3,084,360 | 4/1963 | Hasselroth | 15/21.2 |
| 3,140,498 | 7/1964 | Drescher et al. | 15/97.1 |
| 3,654,655 | 4/1972 | Mitnick | 15/21.2 |
| 4,370,772 | 2/1983 | Gustafsson | 15/97.1 |

FOREIGN PATENT DOCUMENTS

| | | | |
|---|---|---|---|
| 4122059 | 1/1993 | Germany | 15/21.2 |
| 2189156 | 10/1987 | United Kingdom . | |

*Primary Examiner*—Mark Spisich
*Attorney, Agent, or Firm*—Lowe, Price, LeBlanc & Becker

[57] ABSTRACT

A ball cleaning device adapted for use in causing a plurality of billiard balls to be cleaned under a supply of cleaning fluid comprises a housing having a generally cylindrical side wall, a top access opening and a closed bottom; a spindle rotatably fitted through the bottom of the housing to extend upwards along an axis of the housing; a turntable coaxially mounted on the spindle for rotational movement therewith, the turntable supporting the game balls; an idle wheel concentrically mounted on the turntable for rotation relative to the turntable, the idle wheel having a plurality of compartments arranged along its circumference, each of the compartments receiving the game balls in a spaced apart relationship with one another; and an electric motor for rotatably driving the spindle and the turntable in unison to subject the game balls to a random rolling movement and a planetary movement around the spindle so that the idle wheel is pushed by the game balls into rotation about the spindle.

12 Claims, 7 Drawing Sheets

BALL CLEANING DEVICE

FIELD OF THE INVENTION

The present invention is directed to a ball cleaning device and, more particularly, to an apparatus that has the ability to clean, under a continuous supply of cleaning fluid, soiled game balls, e.g., balls for the game of billiards, snooker and the like in a fully automated, time-effective and partial-wear-free fashion.

DESCRIPTION OF THE PRIOR ART

As a rule, billiard balls need to be cleaned as frequently as possible to wide out chalk powder, dirts, specks and finger marks adhered to the surface of the billiard balls during the course of their use. This is mainly because the billiard balls with soiled or unclean surfaces are unlikely to travel straight, when struck by a cue stick, and thus fail to roll over as long a distance as the players normally expect to, eventually depriving the cueist of amusement.

Manual cleaning is a traditional mode of rendering the soiled balls clean and lustrous. Stated more specifically, the billiard balls are first applied with cleaning agent one by one and then vigorously rubbed by use of a soft fabric until the surfaces thereof grow clean. It is customary for the commercialized billiard halls to provide the customers with tens or hundreds of balls at a time, which means that the number of balls to be cleaned within a given period of time would increase accordingly. To manually clean so many billiard balls on an one-by-one basis is time-consuming and highly cumbersome, as a matter of course. At a large-scale billiard hall where scores of cueists may have the games of billiards, no sufficient time would be left to make clean the used balls for the next cycle of use. This will make it unavoidable either to prepare an exceedingly great number of fresh balls beforehand or to employ clerks who should devote themselves to a ball cleaning work.

As an alternative for the manual cleaning, U. K. Patent Publication No. 2189156A teaches a ball cleaning apparatus comprising a housing, the upper part of which contains a motor connected by a transmission means to a cleaning band or belt, the band or belt being arranged in the lower part of the housing in such a manner, in use, as to make frictional contact with the surfaces of a plurality of balls placed in a container disposed in the housing beneath said band or belt. The container may comprise a tray provided with individual compartments for each ball. The housing may contain a reservoir for a cleaning medium which is accessible from the exterior of the housing and which has a delivery means that feeds the cleaning medium to the surface of the cleaning band or belt, from which it is transferred to the balls themselves during the cleaning process.

The ball cleaning apparatus referred to just above may be said to offer a significant advantage over the conventional cleaning technique in that a plurality of balls are cleaned automatically within a short period of time. During the cleaning process, however, the balls would rotate only in a single direction by means of the cleaning belt, thus leaving certain parts of the ball surface uncleaned at all. Another drawback is that specific area of the ball surface is continually kept in frictional contact with the cleaning belt, with the result that a biased or partial abrasion takes place, adversely affecting the rolling characteristic of the balls. Insufficiency in tension of the cleaning belt may cause the cleaning belt to come out of contact with some of the balls placed on the tray such that the non-contacted balls remain dirty even after the cleaning process comes to an end. Additionally, with the ball cleaning apparatus discussed in the '156 publication, it is hard to remove residual cleaning agent from the surfaces of the cleaned balls, nor be it easy to polish the balls at the end of the cleaning process.

SUMMARY OF THE INVENTION

Accordingly, it is an object of the invention to provide a ball cleaning device that can eliminate the drawbacks inherent in the prior art apparatus and that enables a plurality of game balls to be cleaned and polished in a fully automated, highly efficient and partial abrasion free manner.

Another object of the invention is to provide a ball cleaning device capable of automatically supplying a controlled amount of cleaning fluid to the game balls while they are under a cleaning process.

A further object of the invention is to provide a ball cleaning device adapted to carry out the cleaning and the polishing of the game balls, one after the other, at different elevational positions.

A still further object of the invention is to provide a ball cleaning device that can cause the game balls to undergo a combined rolling and planetary movement during the process of cleaning and polishing, while limiting the centrifugal force caused by the planetary movement of the game balls to a predetermined extent.

With these objects in view, the invention provides a ball cleaning device adapted for use in causing a plurality of game balls to come into frictional rolling contact with cleaning fabrics to clean surfaces of the game balls, comprising: a housing having a generally cylindrical side wall, a top access opening and a closed bottom; a spindle rotatably fitted through the bottom of the housing and extending vertically upwards along a central axis of the housing; a turntable coaxially mounted on the spindle for rotational movement therewith, the turntable supporting the game balls; an idle wheel concentrically mounted on the turntable for rotation relative to the turntable, the idle wheel having a plurality of compartments arranged along its circumference, each of the compartments receiving the game balls in a spaced apart relationship with one another; and means for rotatably driving the spindle and the turntable in unison to subject the game balls to a random rolling movement and a planetary movement around the spindle so that the idle wheel is pushed by the game balls into rotation about the spindle.

The ball cleaning device may further comprise means for causing a up-down movement of the turntable and the idle wheel between a lowered position for ball cleaning and a raised position for ball polishing, an overspeed inhibitor means for preventing the idle wheel from rotation over a predetermined speed, means for supplying the game balls with cleaning fluid during the time when the turntable is caused to rotate in the lowered position and means for supplying hot air into the housing to remove the cleaning fluid from the game balls during the time when the turntable is caused to rotate in the raised position.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
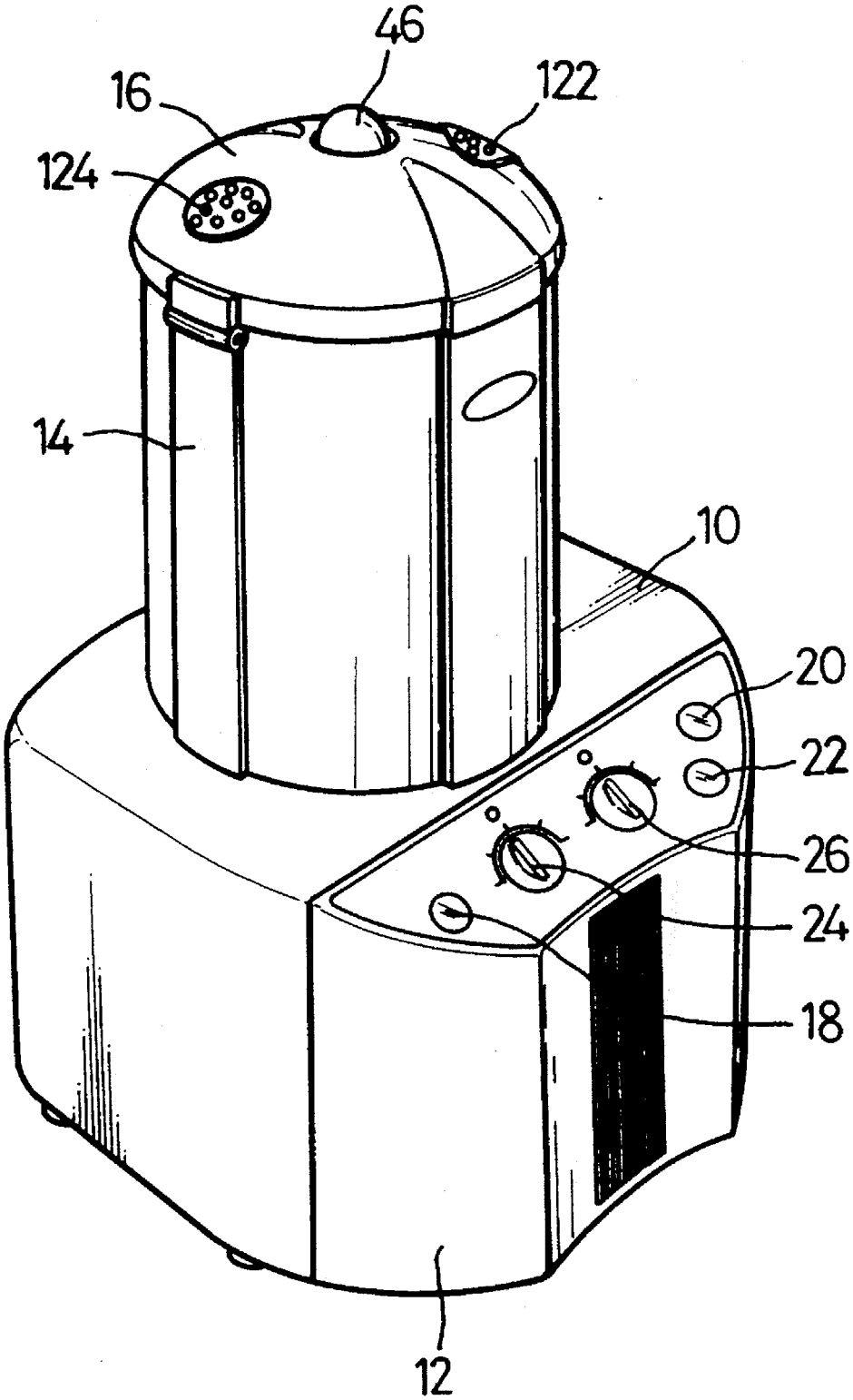
FIG. 1 is a perspective view showing an external appearance of the ball cleaning device in accordance with the invention.

Referring now to FIG. 1, it can be appreciated that the ball cleaning device in accordance with the invention comprises a framework 10, a control box 12 removably attached to the front side of the framework 10, a housing 14 mounted onto the framework 10 and provided with a side wall of generally cylindrical configuration and a lid 16 hingedly secured to the top end of the housing 14. The control box 12 is equipped with a power switch 18, a start switch 20, an emergency stop switch 22, a forward rotation timer switch 24 and a reverse rotation timer switch 26, which are designed to enable the user to operate the ball cleaning device with ease.

Figure 2:
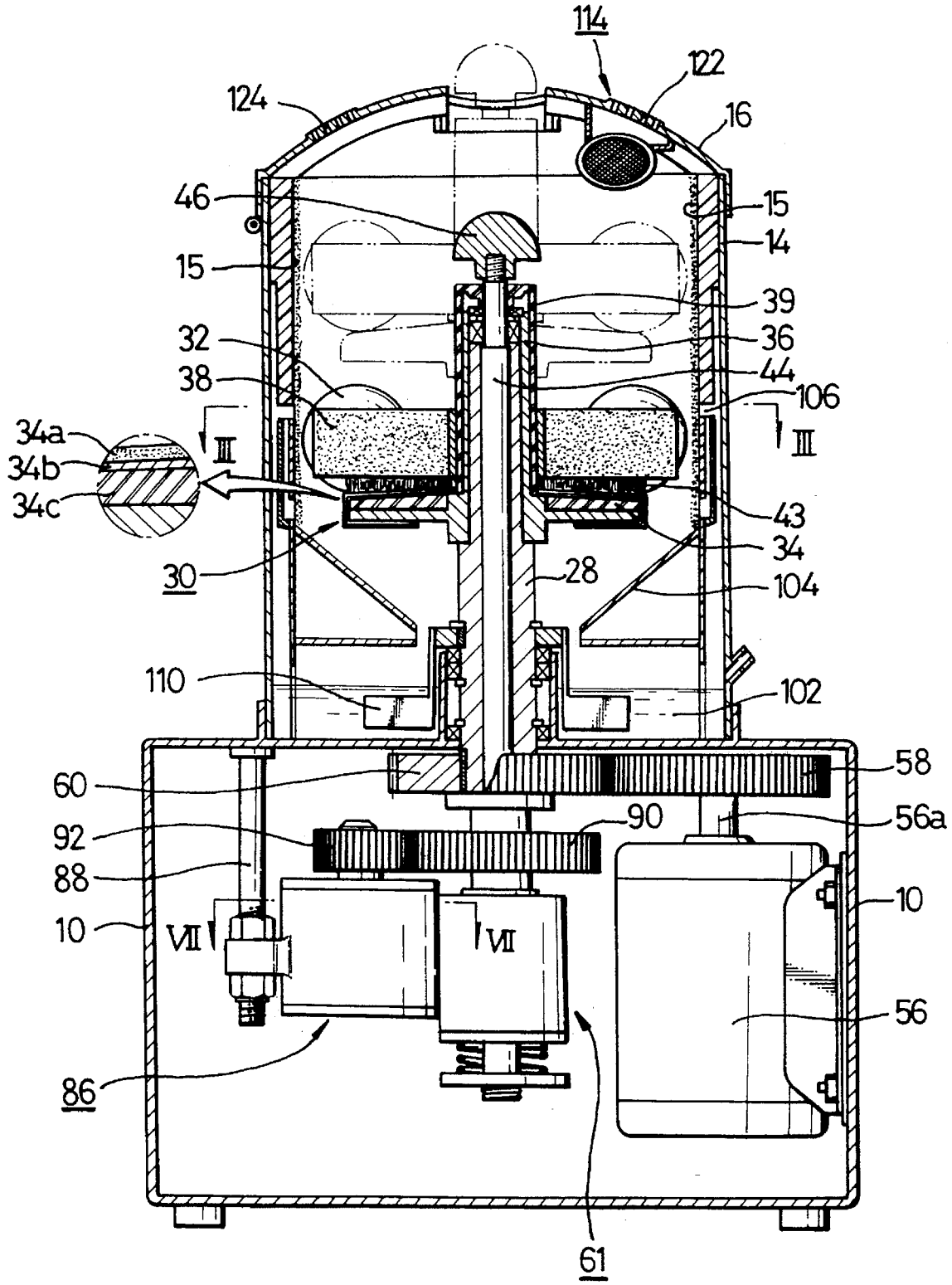
FIG. 2 is a front elevational section view of the ball cleaning device, with a turntable and an idle wheel illustrated in phantom lines in their raised position.

Turning to FIG. 2, there is shown in greater detail the inboard construction of the ball cleaning device wherein the housing 14 has a top access opening openably closed by means of the lid 16 and a blind bottom for the containment of cleaning fluid or like flowable substances. It should be noted that a liner 15 of fluffy cleaning fabric is detachably secured to the inner circumference of the housing 14. A spindle 28 is sealingly and rotatably fitted through the bottom of the housing 14 to extend vertically upwards along a central axis of the latter. An axial bore is formed through and over the full length of the spindle 28 for the reason stated hereinbelow.

Slidably mounted on the spindle 28 as by a key or a spline is a turntable 30 that consists of a disk 34 supporting a plurality of game balls 32, e.g., billiard balls, thereon and a hub 36 projecting upwards from the disk 34 beyond the top end of the spindle 28. The disk 34 may preferably have a top surface which is slanted outwardly and downwardly to allow the game balls 32 placed thereon to roll toward, and come into contact with, the cleaning fabric liner 15 under the influence of gravity. As microscopically illustrated at the left hand side in FIG. 2, the disk 34 of the turntable 30 is composed of a cleaning fabric layer **34*a*, a fluid-proof layer 34*b* and a cushion layer 34*c*, each of which lies one above the other. The cushion layer 34*c* ensures that the disk 34 should support the game balls 32 on the top surface thereof with a resiliency enough to provide acceptable friction contact between the game balls 32 and the disk 34**.

Figure 3:
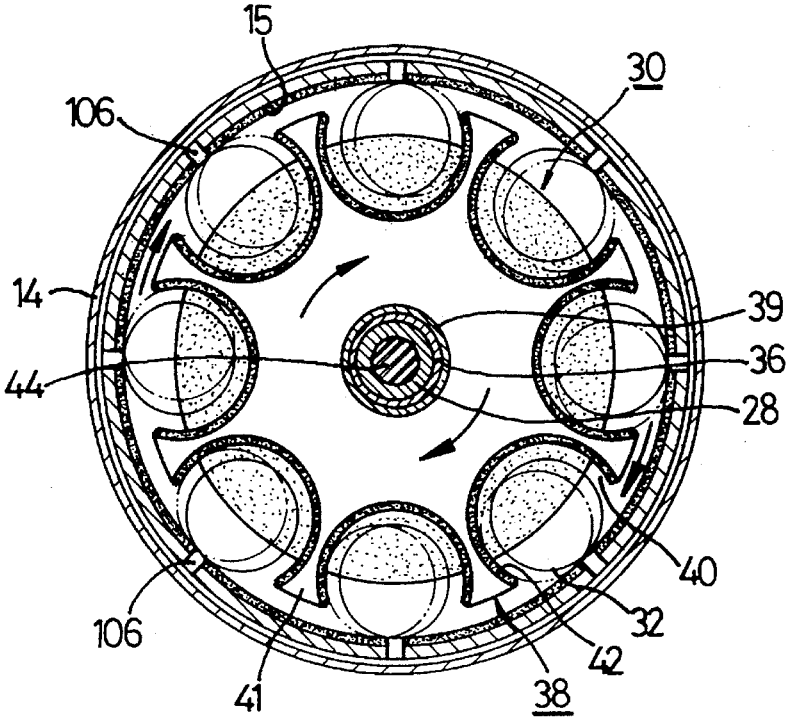
FIG. 3 is a cross-sectional view taken along line III—III, explaining in what manner the idle wheel is pushed into rotation by the game balls during a clockwise rotation of the turntable.

An idle wheel 38 is rotatably mounted on the hub 36 of the turntable 30. The idle wheel 38 includes a hub 39 concentrically fitted on the hub 36 of the turntable 30 and a vane disk 41 fixedly secured to the hub 39 of the idle wheel 38 for rotation therewith as a unit. The vane disk 41 is provided with a plurality of, e.g., semicircular, compartments 40 that are uniformly spaced along the perimeter of the vane disk 41 to receive balls in a spaced apart relationship with one another, as best shown in FIG. 3. It is preferred that a strip-like cleaning fabric 42 should be attached to the curved wall of the respective compartment 40.

Although the vane disk 41 of the idle wheel 38 is shown to have eight compartments 40 in FIG. 3, the exact number of the compartments 40 is a matter of design choice and may be greater or lesser. Stated differently, the compartments 40 should be as many as twenty two to accommodate a set of balls for the "snooker" game at a time, whereas sixteen compartments are needed to receive a single set of balls for the game of pocket billiards or "pool".

It can be also noted that a brush 43 is affixed to the undersurface of the vane disk 41 of the idle wheel 38 with its tip yieldably contacting the top surface of the turntable 30. As the idle wheel 38 is caused to rotate relative to the turntable 30, the brush 43 acts to "dress" the top surface of the disk 34, thereby removing particles or debris stuck thereto and, at the same time, regenerating the cleaning fabric layer of the disk 34.

Figure 4:
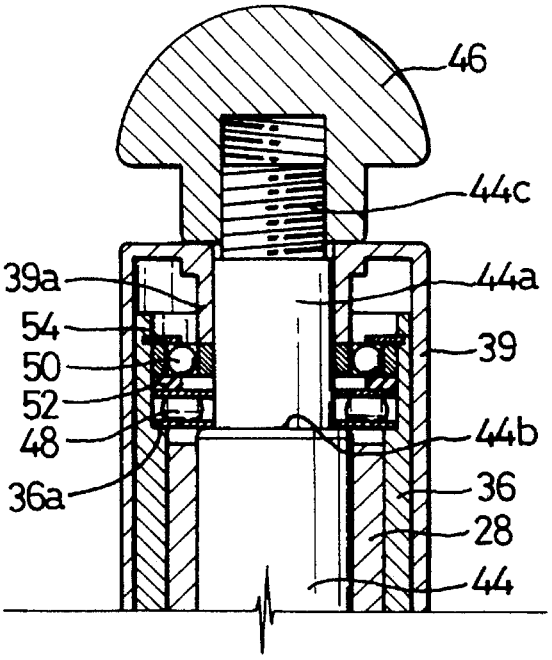
FIG. 4 is a partially enlarged, sectional view showing the fitting relationship of a spindle, a lead screw shaft, a turntable hub and an idle wheel hub.

Referring back to FIG. 2, a lead screw shaft 44 is inserted through the axial bore of the spindle 28 for rotation and axial displacement with respect to the spindle 28. The lead screw shaft 44, as dearly shown in FIG. 4, is provided with a head **44*a* of reduced diameter protruding upwards beyond the top end of the spindle 28 and an annular shoulder 44*b* formed between the head 44*a* and the remainder of the spindle 28. In addition, the head 44*a* of the lead screw shaft 44 has an externally threaded free end 44*c* to which a hemispherical cap nut 46** is threadedly coupled in a removable manner.

Provided between the head **44*a* of the lead screw shaft 44 and the hub 36 of the turntable 30 is an annular gap into which a thrust bearing 48 and a radial bearing 50 arc inserted snugly, with a spacer ring 52 interposed therebetween. In the illustrated embodiment, the thrust bearing 48 and the radial bearing 50 are retained in place by virtue of a stop surface 36*a* formed somewhere inside the hub 36 of the turntable 30 and a snap ring 54 positioned at the free end of the hub 36**.

The idle wheel 38 includes a collar **39*a* that constitutes a further continuation of the hub 39 and surrounds the head 44*a* of the lead screw shaft 44. The collar 39*a* is pressed against the inner race of the radial bearing 50 by way of tightening the cap nut 46, whereby the idle wheel 38 will become able to move together with the lead screw shaft 44, relative to the spindle 28 and the hub 36 of the turntable 30. In contrast, whenever the lead screw shaft 44 moves up and down in the way set forth below, the turntable 30 as well as the idle wheel 38 will be caused to move axially upwards or downwards along with the lead screw shaft 44**.

As is apparent in FIG. 2, the spindle 28 and hence the turntable 30 can be rotatably driven in the forward or reverse direction by means of an electric motor 56. The torque produced by the electric motor 56 is transmitted to the spindle 28 via a drive gear 58 carried by an output shaft 56*a* of the electric motor 56 and a driven gear 60 attached to the lower end of the spindle 28. Forward rotation of the electric motor 56 will cause the spindle 28 and the turntable 30 to turn clockwise. This ensures that the game balls 32 on the turntable 30 should move into a position illustrated in phantom lines in FIG. 3, thus pushing the idle wheel 38 clockwise to cause the idle wheel 38 and the lead screw shaft 44 to rotate in the same direction as, but at a speed less than, the spindle 28 and the turntable 30.

Figure 5:
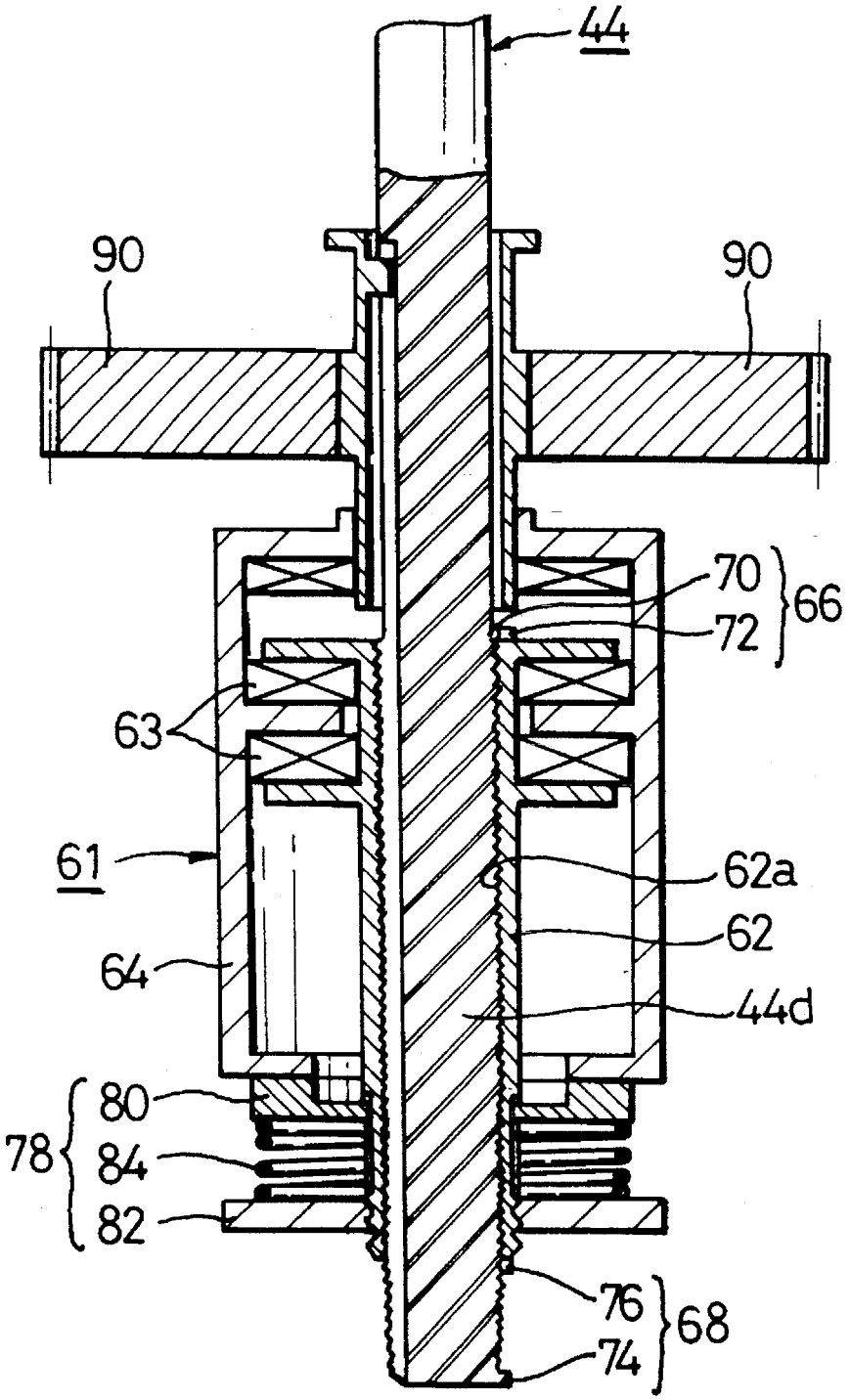
FIG. 5 shows, in cross-section, a up-down movement control unit which enables the lead screw shaft, during its forward or reverse rotation, to move upwards or downwards together with the turntable and the idle wheel, in which view the lead screw shaft assumes a lowermost position.

Referring to FIG. 5, there is shown in cross-section a up-down movement control unit 61 that enables the lead screw shaft 44 to move axially upwards or downwards, depending on the direction of rotation of the lead screw shaft 44, to thereby bring the turntable 30 and the idle wheel 38 either into a lowered position in which the game balls 32 are subjected to cleaning and a raised position in which the game balls 32 are subjected to polishing. It should be understood that the lead screw shaft 44 is provided with at its lower extension a male thread portion 44*d* which cooperates with the up-down movement control unit 61 to cause axial displacement of the lead screw shaft 44 between a lowermost position corresponding to the lowered position of the turntable 30 and a uppermost position corresponding to the raised position of the turntable 30.

In the embodiment shown in FIG. 5, the the up-down movement control unit 61 includes a sleeve 62 having a female thread portion 62*a* that comes into engagement with the male thread portion 44*d* of the lead screw shaft 44. The sleeve 62 is rotatably held by means of a stationary support 64, with bearings 63 interposed between the sleeve 62 and the stationary support 64. It should be noted that the stationary support 64 is immovably affixed to the framework 10 through a suitable fastener not shown in the drawings for the sake of simplicity.

The up-down movement control unit 61 further includes a upper stopper arrangement 66 that serves to prohibit rotational movement of the lead screw shaft 44 relative to the sleeve 62 at the time when the lead screw shaft 44 is in the lowermost position and a lower stopper arrangement 68 that performs the same task as the upper stopper arrangement 66 at the time when the lead screw shaft 44 is in the uppermost position. The upper stopper arrangement 66 comprises a claw 70 projecting a short distance from the lead screw shaft 44 and a lug 72 provided on the sleeve 62 to abut the claw 70 as the lead screw shaft 44 descends to the lowermost position, as shown in FIG. 5. Likewise, the lower stopper arrangement 68 comprises a claw 74 formed on the lead screw shaft 44 with a predetermined spacing from the claw 70 of the upper stopper arrangement 66 and a lug 76 provided on the sleeve 62 in such a position as to come into abutment with the claw 74 of the lower stopper arrangement 68 as the lead screw shaft 44 ascends to the uppermost position as illustrated in FIG. 6.

Figure 6:
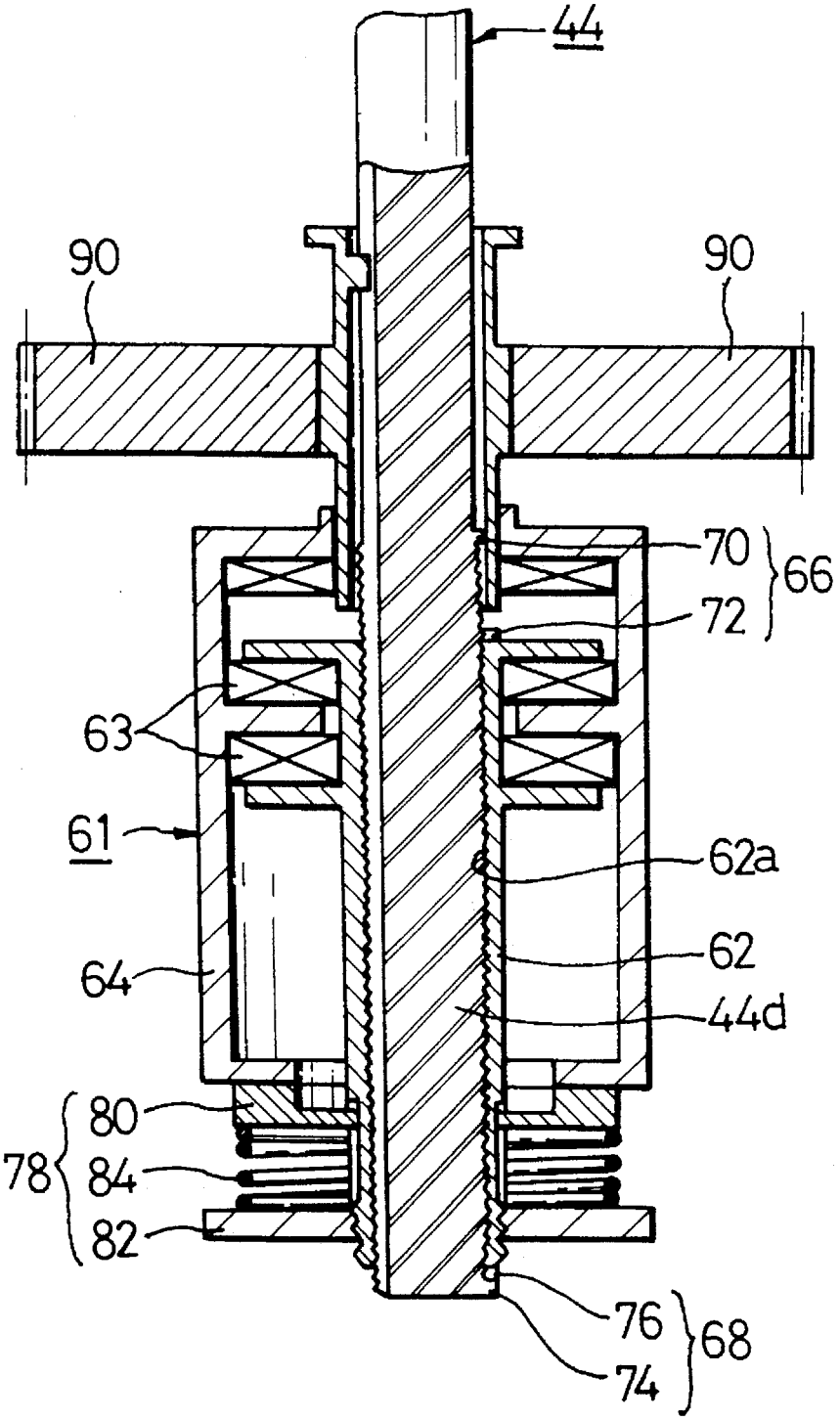
FIG. 6 is a view similar to FIG. 5 but illustrating the lead screw shaft which has moved to the uppermost position.

Referring collectively to FIGS. 5 and 6, it can be seen that the sleeve 62 is frictionally anchored to the stationary support 64 by way of a friction clutch 78. As shown, the friction clutch 78 includes a pressure plate 80 fitted axially slidably, yet non-rotatably, on the sleeve 62, a spring retainer 82 threadly engaged with the bottom end of the sleeve 62 in a spaced apart relationship with the pressure plate 80 and a compression spring 84 held in position between the the pressure plate 80 and the spring retainer 82 to urge the pressure plate 80 against the undersurface of the stationary support 64. In the event that a relatively weak torque exerts on the sleeve 62, i.e., the lead screw shaft 44 rotates at a certain position other than the uppermost and lowermost positions, the friction clutch 78 acts to keep the sleeve 62 firmly anchored to the stationary support 64, thereby prohibiting the former from any rotation relative to the latter. In contrast, if a strong torque exerts on the sleeve 62 through the lower or upper stopper arrangement, i.e., the lead screw shaft 44 rotates at either of the uppermost and lowermost positions, the pressure plate 80 of the friction clutch 78 will slip on the undersurface of the stationary support 64. Such a slippage allows the sleeve 62 to rotate together with the lead screw shaft 44 in unison, assuring that the lead screw shaft 44 is subjected to no further descending or ascending movement.

Figure 7:
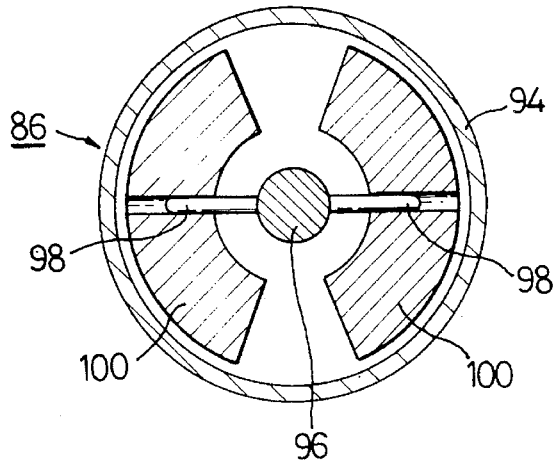
FIG. 7 is a cross-sectional view taken along line VII—VII, showing a centrifugal overspeed inhibitor unit operatively connected to the lead screw shaft.

Referring again back to FIG. 2, it can be confirmed that an overspeed inhibitor unit 86 is fixedly secured to the framework 10 through a bar-like bracket 88 in the vicinity of the up-down movement control unit 61. The overspeed inhibitor unit 86 is adapted to receive a torque from the lead screw shaft 44 via a drive gear 90 and a driven gear 92, both of which remain in a meshing engagement with each other. As best illustrated in FIG. 7, the overspeed inhibitor unit 86 includes a rotary shaft 96 drivingly associated with the lead screw shaft 44, a cylindrical casing 94 encircling the rotary shaft 96 in a coaxial relationship therewith, a pair of radial pins 98 each extending oppositely from the rotary shaft 96 toward the inner circumference of the casing 94 and a pair of centrifugal shoes 100 slidably carried by the radial pins 98. Each of the centrifugal shoes 100 will expand radially outwardly into frictional contact with the inner circumference of the casing 94 in the event that the lead screw shaft 44 and hence the rotary shaft 96 would rotate beyond a predetermined speed, thus maintaining the rotational speed of the lead screw shaft 44 and the idle wheel 38 within a permissible range.

It is preferred that, in the process of cleaning the game balls 32 at the lowered position, a cleaning fluid continues to be fed to the surface of the game balls 32 and/or the environmentally arranged cleaning fabrics to enhance the cleaning efficiency. To do this, a fluid chamber 102 is provided on the bottom, of the housing 14, as depicted in FIG. 2. The fluid chamber 102 is spatially isolated from the turntable 30 by virtue of a radially inwardly extending, annular partition wall 104 whose cross-section is of generally triangular configuration.

Figure 8:
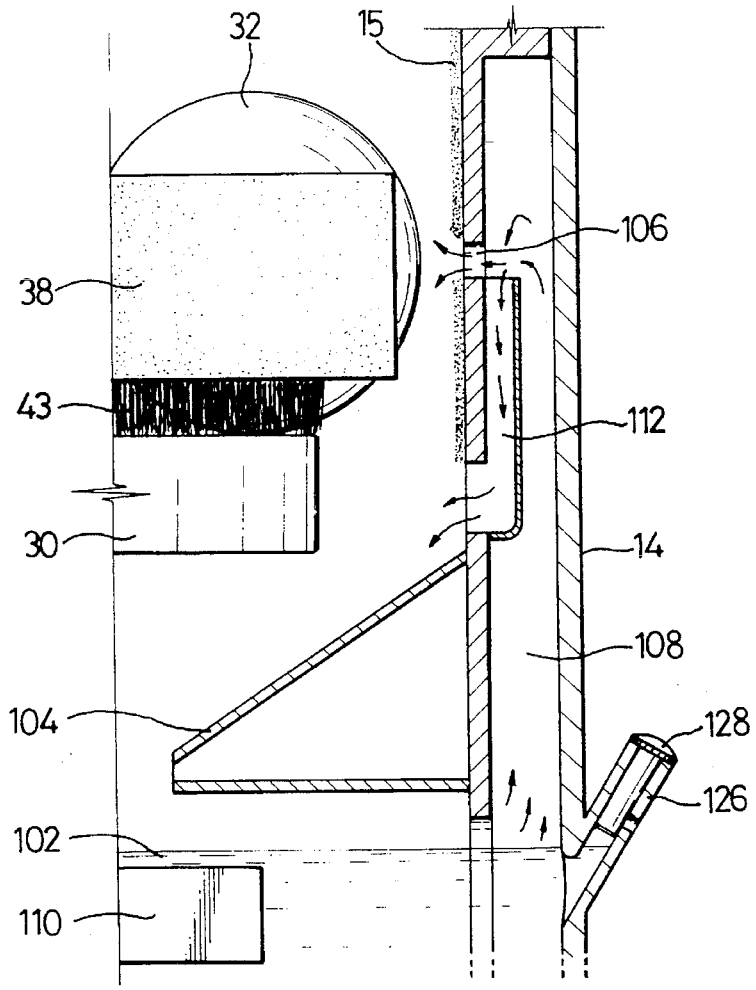
FIG. 8 is a partially enlarged, sectional view representing a cleaning fluid supply system designed to feed the cleaning fluid to the game balls as it is cleaned in the lowered position.

As most apparently illustrated in FIGS. 3 and 8, a plurality of fluid discharge holes 106 are circumferentially disposed on the cylindrical side wall of the housing 14 to spout the cleaning fluid toward the game balls 32 as the ball cleaning proceeds in the lowered position. Each of the fluid discharge holes 106 is in a fluid communication with the fluid chamber 102 through a fluid passageway 108 defined in the side wall of the housing 14. Fixedly secured to the spindle 28 and submerged in the cleaning fluid is an impeller 110 that can force the cleaning fluid into the fluid passageway 108 in response to the rotation of the spindle 28. If desired, a bypass channel 112 can be provided just below the individual fluid discharge hole 106 such that at least a part of the cleaning fluid forced into the fluid passageway 108 may circumvent the fluid discharge holes 106 and then be leaked into the space below the turntable 30, whereby the pressure at which the cleaning fluid is injected through the fluid discharge holes 106 can be kept from surging above an acceptable level.

Figure 9:
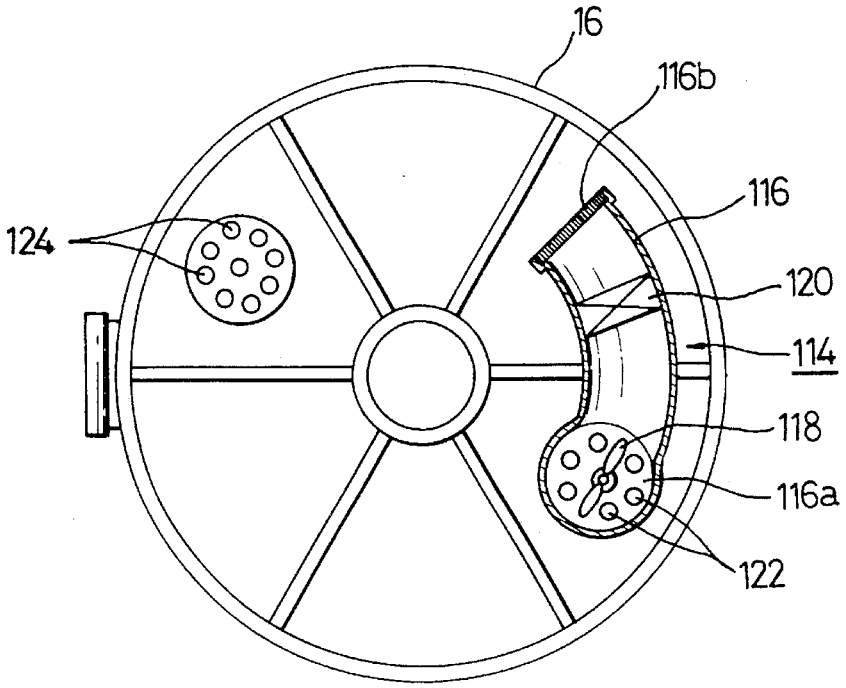
FIG. 9 is a plan view showing the interior surface of a lid on which a hot air supplying unit is mounted fixedly.

With reference to FIGS. 2 and 9, it can be appreciated that a hot air supplying unit 114 is installed somewhere on the interior side of the lid 16. The hot air supplying unit 114 serves to blow a hot air into the housing 14 to remove or evaporate the residual cleaning fluid from the game balls 32 and their environmental structure during the course of polishing the game balls 32, namely, when the turntable 30 and the idle wheel 38 are caused to rotate in the raised position. In the illustrated embodiment, the hot air supplying unit 114 includes a duct 116 secured to the inner surface of the lid 16, the duct having inlet and outlet ends 116*a*, 116*b*, an electric fan 118 mounted adjacent to the inlet end 116*a* of the duct 116 to inhale an ambient air into the duct 116 and a heater 120 disposed between the electric fan 118 and the outlet end 116*b* of the duct 116 to elevate the temperature of an inhaled ambient air flowing therethrough. Moreover, a group of air introduction holes 122 are perforated in the first area of the lid 16 which corresponds to the inlet end 116a of the duct 116, whereas a group of air discharge holes 124 are defined in the second area of the lid 16 distant from the first area.

Figure 10:
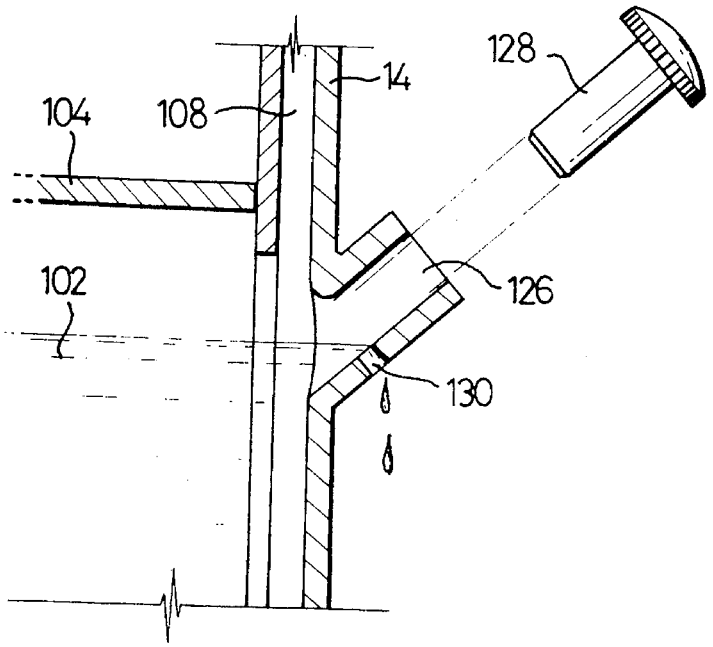
FIG. 10 is a partially enlarged, sectional view illustrating a cleaning fluid infusion nozzle formed on the side wall of the housing.

Referring lastly to FIG. 10, extending outwardly upwards from the side wall of the housing 14 is a fluid infusion nozzle 126 that allows the user to fill the cleaning fluid into the fluid chamber 102. Normally, the fluid infusion nozzle 126 remains closed off as by a rubber plug 128 to prevent the cleaning fluid from leakage. It is desirable that the fluid infusion nozzle 126 should have a fluid volume adjustment hole 130 permitting the surplus cleaning fluid to drain therethrough.

Operation of the instant ball cleaning device will now be set out with reference mainly to FIG. 2. Prior to starting the device, the turntable 30 and the idle wheel 38 are kept in the raised position as shown in double-dotted lines in FIG. 2. The user can open the lid 16 to put a plurality of game balls 32, e.g., billiard balls, onto the turntable 30, after which the lid 16 is closed to place the device in condition for start-up. The power switch 18 is then turned on, with the forward rotation and reverse rotation timer switches 24, 26 individually turned to desired angular positions to set the time periods for ball cleaning and subsequent ball polishing, respectively. Responsive to pressing the start switch 20, the electric motor 56 begins to rotate in the forward direction.

Such a forward rotation of the electric motor 56 will cause the spindle 28 and the turntable 30 to rotate clockwise in FIG. 3, with the result that the game balls 32 move from the solid line position to the dotted line one, pushing the idle wheel 38 in the clockwise direction. In response, the idle wheel 38 and the lead screw shaft 44 are caused to rotate clockwise as a unit, independently of the rotational movement of the spindle 28 and the turntable 30. With the aid of the up-down movement control unit 61, the lead screw shaft 44 descends slowly together the turntable 30 and the idle wheel 38 into the lowermost position as shown in FIG. 5.

In the lowermost position, the torque will be delivered from the lead screw shaft 44 to the sleeve 62 altogether, causing the sleeve 62 to rotate along with the lead screw shaft 44 against the frictional resistance developed between the pressure plate 80 and the stationary support 64 of the friction clutch 78. Accordingly, the lead screw shaft 44 will no longer be subjected to a downward movement but continues to rotate in that position at a gradually increasing speed. At this time, the overspeed inhibitor unit 86 shown in FIGS. 2 and 7 comes to prohibit the lead screw shaft 44 and the idle wheel 38 from rotating beyond a predetermined speed, which would otherwise cause the game balls 32 to unwantedly rebound out of the compartments 40 of the idle wheel 38.

Having pulled down in this way into the lowered position as indicated in a solid line in FIG. 2, the turntable 30 and the idle wheel 38 will continue to rotate at a controlled speed for the period of time set by the forward rotation timer switch 24. In this process, the game balls 32 are subjected to a thorough cleaning by the environmentally disposed cleaning fabrics, while undergoing a random rolling movement and a planetary movement around the spindle 28. As the game balls 32 are cleaned in the lowered position, the impeller 110 will be rotatingly driven by the spindle 28 in such a manner as to feed the cleaning fluid onto the game balls 32 through the fluid passageway 108 and the fluid discharge holes 106, further enhancing the ball cleaning efficiency.

Just after the forward rotation timer switch 24 is turned off to terminate the ball cleaning process, the reverse rotation timer switch 26 comes to work, in turn, to thereby have the electric motor 56 rotate in the reverse direction. Such a reverse rotation of the electric motor 56 will cause the spindle 28 and the turntable 30 to rotate counterclockwise in FIG. 3, with the result that the game balls 32 move from the solid line position in the opposite direction, pushing the idle wheel 38 counterclockwise. In response, the idle wheel 38 and the lead screw shaft 44 are caused to rotate counterclockwise as a unit, independently of the rotational movement of the spindle 28 and the turntable 30. With the aid of the up-down movement control unit 61, the lead screw shaft 44 ascends slowly together the turntable 30 and the idle wheel 38 into the uppermost, initial position as shown in FIG. 6.

In the uppermost position, the torque will be delivered from the lead screw shaft 44 to the sleeve 62 altogether, causing the sleeve 62 to rotate along with the lead screw shaft 44 against the frictional resistance established between the pressure plate 80 and the stationary support 64 of the friction clutch 78. Accordingly, the lead screw shaft 44 will no longer be subjected to a upward movement but continues to rotate in that position at a gradually increasing speed. At this time, the overspeed inhibitor unit 86 shown in FIGS. 2 and 7 comes to prohibit the lead screw shaft 44 and the idle wheel 38 from rotating beyond a predetermined speed.

Having pulled up in this way into the raised position as indicated in a phantom line in FIG. 2, the turntable 30 and the idle wheel 38 will continue to rotate at a controlled speed for the period of time set by the reverse rotation timer switch 26. Absent any supply of the cleaning fluid in the raised position, the game balls 32 are subjected to a thorough polishing by the environmentally disposed cleaning fabrics, while undergoing a random rolling movement and a planetary movement around the spindle 28 in the same way as stated above.

As soon as the turntable 30 and the idle wheel 38 are brought into the raised position, the hot air supply unit 114 will be automatically operated to blow a hot air into the housing 14, thus removing the residual cleaning fluid from the game balls 32, the turntable 30 and the idle wheel 38, which would help shorten the time period for polishing the game balls 32. Once the polishing process comes to an end, the user is able to take out the game balls 32 for subsequent use. The termination of the polishing process can be readily confirmed by way of visually observing whether the cap nut 46 that has been exposed to the outside through an apex aperture of the lid 16 remains stationary or rotating.

While the invention has been described with reference to a preferred embodiment, it should be apparent to those skilled in the art that many changes and modifications may be made without departing from the spirit and scope of the invention as defined in the claims.

What is claimed is:

1. A ball cleaning device, comprising:

a housing having a side wall, a top access opening and a bottom;

a cleaning fabric provided on an inner surface of the side wall;

a spindle rotatably fitted through the bottom of the housing to extend upwards in parallel to the side wall;

a turntable coaxially mounted on the spindle for rotational movement therewith, said turntable adapted to support a plurality of game balls;

an idle wheel mounted on the turntable for rotation relative to the turntable, said idle wheel having a plurality of compartments arranged along a circumference thereof, each compartment receiving a respective one of the game balls in a spaced apart relationship with one another; and means for rotatably driving the spindle and the turntable in unison to subject the game balls to a rolling movement and a planetary movement around the spindle so that the idle wheel is pushed by the game balls into rotation about the spindle.

2. The ball cleaning device as recited in claim 1, wherein the turntable is axially slidable along the spindle and wherein the idle wheel is freely rotatable and axially immovable with respect to the turntable.

3. The ball cleaning device as recited in claim 2, further comprising means for causing a up-down movement of the turntable and the idle wheel between a lowered position where the game balls are cleaned and a raised position where the game balls are polished.

4. The ball cleaning device as recited in claim 3, wherein the up-down movement means comprises: a lead screw shaft rotatably fitted through the spindle for axial movement between uppermost and lowermost positions, the lead screw shaft having a top end portion to which the idle wheel is mounted fixedly and a bottom male thread portion; a sleeve having a female thread hole threadedly engaged with the male thread portion to enable the lead screw shaft to move from the uppermost position into the lowermost position and vice versa; a stationary support for holding the sleeve rotatably; stopper means for inhibiting the lead screw shaft from rotation relative to the sleeve at the uppermost and lowermost positions; and means for securing the sleeve with respect to to the stationary support to enable the lead screw shaft to move axially when the lead screw shaft is caused to rotate at a position other than the uppermost and lowermost positions and for allowing the sleeve to rotate together with the lead screw shaft, relative to the stationary support, when the lead screw shaft is caused to rotate at one of the uppermost and lowermost positions.

5. The ball cleaning device as recited in claim 4, further comprising an overspeed inhibitor means for preventing the lead screw shaft and the idle wheel from rotation over a predetermined speed.

6. The ball cleaning device as recited in claim 5, wherein the overspeed inhibitor means comprises: a rotary shaft operatively connected to the lead screw shaft for rotation therewith, the rotary shaft having a pair of oppositely extending radial pins; a cylindrical casing coaxially surrounding the rotary shaft, the casing having an inner circumferential surface; and a pair of centrifugal shoes each slidably engaged with the respective radial pin of the rotary shaft, whereby the centrifugal shoes can expand radially outwards into frictional contact with the inner circumferential surface of the casing as the lead screw shaft and the idle wheel are caused to rotate over the predetermined speed.

7. The ball cleaning device as recited in claim 3, further comprising means for supplying the game balls with cleaning fluid during the time when the turntable is caused to rotate in the lowered position.

8. The ball cleaning device as recited in claim 7, wherein the cleaning fluid supply means comprises: a fluid chamber provided at the bottom of the housing; a plurality of fluid discharge holes each disposed on the side wall of the housing to spout the cleaning fluid toward the game balls in the lowered position; a fluid passageway defined in the sidewall of the housing to provide fluid communication between the fluid chamber and the fluid discharge holes; and an impeller fixedly secured to the spindle within the fluid chamber for forcing the cleaning fluid into the fluid passageway as the impeller is rotatably driven by the spindle.

9. The ball cleaning device as recited in claim 8, wherein the fluid chamber is substantially isolated from the turntable by means of an annular partition wall which extends radially inwards from the side wall of the housing.

10. The ball cleaning device as recited in claim 9, wherein the cleaning fluid supply means further comprises a bypass channel for allowing at least a part of the cleaning fluid forced into the fluid passageway to circumvent the fluid discharge holes and thereby to be leaked into a space below the turntable.

11. The ball cleaning device as recited in claim 7, further comprising a lid hingedly attached to the housing to close off the top access opening and means carried by the lid for supplying a hot air into the housing to remove the cleaning fluid from the game balls during the time when the turntable is caused to rotate in the raised position.

12. The ball cleaning device as recited in claim 11, wherein the hot air supplying means comprises a duct fixedly secured to the lid, the duct having an inlet end and an outlet end, a fan disposed adjacent to the inlet end of the duct to inhale ambient air and a heater housed within the duct at a position downstream of the fan to heat the inhaled ambient air.

* * * * *